US008758052B2

(12) United States Patent
Huang

(10) Patent No.: US 8,758,052 B2
(45) Date of Patent: Jun. 24, 2014

(54) TERMINAL LOAD

(71) Applicant: Din Yi Industrial Co., Ltd., New Taipei (TW)

(72) Inventor: Ching Kun Huang, New Taipei (TW)

(73) Assignee: Din Yi Industrial Co., Ltd., New Taipei (TW)

( * ) Notice: Subject to any disclaimer, the term of this patent is extended or adjusted under 35 U.S.C. 154(b) by 113 days.

(21) Appl. No.: 13/622,138

(22) Filed: Sep. 18, 2012

(65) Prior Publication Data

US 2014/0080358 A1 Mar. 20, 2014

(51) Int. Cl.
*H01R 9/05* (2006.01)

(52) U.S. Cl.
USPC ..... 439/583; 439/581

(58) Field of Classification Search
CPC ..... H01R 9/0521; H01R 13/622; H01R 2201/18; H01R 24/50; H01R 9/05; H01R 9/0515; H01R 43/20; H01R 13/6658; H01R 13/20; H01R 12/721; H01R 9/096; H01R 12/716
USPC ..... 439/538–584
See application file for complete search history.

(56) References Cited

U.S. PATENT DOCUMENTS

| | | | | |
|---|---|---|---|---|
| 5,662,494 | A * | 9/1997 | Zennamo et al. | 439/589 |
| 6,688,916 | B1 * | 2/2004 | Lee | 439/620.03 |
| 7,278,887 | B1 * | 10/2007 | Palinkas et al. | 439/620.03 |
| 7,393,245 | B2 * | 7/2008 | Palinkas et al. | 439/620.03 |
| 7,896,695 | B1 * | 3/2011 | Huang | 439/578 |

* cited by examiner

*Primary Examiner* — Xuong Chung Trans
(74) *Attorney, Agent, or Firm* — Rabin & Berdo, P.C.

(57) ABSTRACT

A terminal load includes an insulating cylinder internally defining a receiving space having a locating surface, and having a front open end and a rear end provided with a notch; an insulating cap mounted to the front open end of the insulating cylinder; a circuit board mounted on the locating surface to rearwardly project a rear narrowed section from the notch; a connection terminal electrically connected with the circuit board to forward extend through the insulating cap; and a conductive cap having a top hole and fitted around the rear end of the insulating cylinder with the rear narrowed section of the circuit board extended through the top hole and clamped between two contacting arms at two opposite sides of the top hole. The terminal load with the above structure can be driven by punching to safely assemble to an outer housing, and the conductive cap ensures good conducting effect.

7 Claims, 7 Drawing Sheets

TERMINAL LOAD

FIELD OF THE INVENTION

The present invention relates to a terminal load, and more particularly to a terminal load that ensures upgraded conductivity and stability in use and allows quick and safe assembling of it to an outer housing to achieve high productivity.

BACKGROUND OF THE INVENTION

Generally, coaxial cables are widely used with cable televisions for signal transmission. Coaxial cables have the advantages of large bandwidth and not easily subjected to noise and signal interference, and are therefore also used by many broadband network providers as a signal transmission medium.

Please refer to FIG. 1. A conventional coaxial terminal load 1 includes a cap 10, a conductive terminal 11, and a circuit board 12. The cap 10 has a first hole 101. The conductive terminal 11 has a front end forward extended through and projected from the first hole 101, and a rear end engaged with a second hole 121 formed on a front end of the circuit board 12 to electrically connect the conductive terminal 11 to the circuit board 12. Two conducting pins 122 are welded to a rear end of the circuit board 12 to locate perpendicular to an extending direction of the circuit board 12. Two free ends of the two conducting pins 122 form a ground surface 123 each.

FIG. 2 shows a general way of assembling the terminal load 1 to an outer housing 20 by pressing against the cap 10. When the terminal load 1 is fitted in the outer housing 20, the two conducting pins 122 are elastically pressed against an inner wall surface of a barrel portion 201 of the outer housing 20 to constitute a ground structure. However, by pressing against the cap 10 to drive the terminal load 1 into the barrel portion 201, the very thin conducting pins 122 are easily subjected to bending or breaking during the assembling, particularly when an improper force is applied to the cap 10. Meanwhile, since the two ground surfaces 123 are so small, the conductive terminal 11 tends to have poor conductivity and results in a defective product. Therefore, the conventional terminal load 1 does not suitable for assembling to the outer housing 20 by way of pressing, and is prevented from being quickly manufactured by mass production.

Further, the conductive terminal 11 is held in place only by the cap 10 that has an outer circumferential surface pressed against a diameter-expanded locking ring portion 202 formed at a front open end of the outer housing 20. The extremely thin conducting pins 122 just fail to provide sufficient supporting strength to stably set the circuit board 12 in the outer housing 20, so that the conductive terminal 11 along with the conducting pins 122 tend to shake when the terminal load 1 is in use, causing poor electrical contact of the conducting pins 122 with the outer housing 20. The conducting pins 122 are even subjected to breaking when the shaking thereof is too serious. This would of course shorten the service life of the terminal load.

It is therefore desirable to overcome the drawbacks in the conventional terminal load by developing an improved terminal load that ensures upgraded conductivity and stability in use, prolonged service life, and increased good yield.

SUMMARY OF THE INVENTION

A primary object of the present invention is to provide a terminal load that is not easily shaken and provides good conductivity during use.

Another object of the present invention is to provide a terminal load that can be quickly produced to lower the manufacturing cost thereof and avoid unnecessary waste of time and labor.

To achieve the above and other objects, the terminal load according to the present invention includes an insulating housing, a circuit board, a connection terminal, a conductive cap and an outer housing. The insulating housing includes an insulating cylinder internally defining a receiving space and having a front end forming an opening and a rear end provided with a notch; and an insulating cap having a centered third hole and mounted to the opening of the insulating cylinder. The circuit board is mounted in the receiving space in the insulating cylinder and has a rear end formed into a length of narrowed section to extend through and project from the notch on the rear end of the insulating cylinder. The connection terminal is electrically connected with a front end of the circuit board to forward extend through the third hole and project from the insulating cap. The conductive cap is fitted around the rear end of the insulating cylinder and has a fifth hole formed on a top wall thereof. The rear narrowed section of the circuit board projected from the notch is extended through the fifth hole to project from and be clamped to the conductive cap.

In a preferred embodiment, the receiving space in the insulating cylinder internally provides a locating surface, to which the circuit board is mounted to locate in place; and the circuit board is provided at the front end with a fourth hole, through which the connection terminal is extended to electrically connect with the circuit board.

In a preferred embodiment, the conductive cap includes a plurality of clamping surfaces forward extended from and spaced along an outer edge of the top wall to clamp on the insulating housing. The clamping surfaces respectively have two stepped lateral sides and an extended central section; and the extended central sections are fitted around a length of the rear end of the insulating cylinder. Further, the conductive cap also includes two contacting arms rearwardly extended from two opposite sides of the fifth hole to clamp on and get in surface contact with the rear narrowed section of the circuit board.

According to the present invention, the terminal load further includes an outer housing fitted on an outer side of the insulating housing. The outer housing includes a barrel portion, which has a front open end expanded in both inner and outer diameters to form an integral locking ring portion, and the locking ring portion is provided on an inner surface with screw threads.

The locating surface in the insulating cylinder provides a place for stably mounting the circuit board and the notch on the rear end of the insulating cylinder engages with the rear narrowed section of the circuit board, so that the circuit board does not shake when the terminal load is in use. The conductive cap is fitly clamped around the rear end of the insulating cylinder and accordingly does not break or wear during the process of punching the terminal load into the outer housing. Further, the conductive cap provides large contact surface area to tightly contact with the barrel portion of the outer housing, ensuring good conductivity of the terminal load.

Under the protection provided by the insulating housing, the circuit board and the connection terminal mounted therein are not subjected to impact and vibration during the punching process to cause damaged parts and defective products. The configuration of the insulating housing ensures successful assembling of it to the outer housing. Since the insulating cylinder is a cylindrical body matching an inner wall surface of the barrel portion, the insulating housing is in tight contact with the outer housing after being fitted in the outer housing. This also enables quick production and increased productivity, and accordingly, lowered manufacturing cost.

In brief, the present invention is characterized by mounting the circuit board on the locating surface in the insulating cylinder, projecting the rear narrowed section of the circuit board through the notch formed on the rear end of insulating cylinder, and clamping the rearwardly projected narrowed section of the circuit board in the hole and between the contacting arms formed on the conductive cap, so that the circuit board would not shake when the terminal load is in use. The present invention is also characterized in that the conductive cap provides large contact surface area with the inner surface of the barrel portion of the outer housing, and this together with the fact that the rear narrowed section of the circuit board is clamped between the contacting arms ensure good conducting effect of the terminal load. Moreover, the insulating housing provides protection to the connection terminal and the circuit board, so that they are not damaged in the process of punching the terminal load into the barrel portion of the outer housing to cause defective products. This enables quick production of the terminal load to reduce the manufacturing cost thereof.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and with reference to the accompanying drawings.

Figure 1:
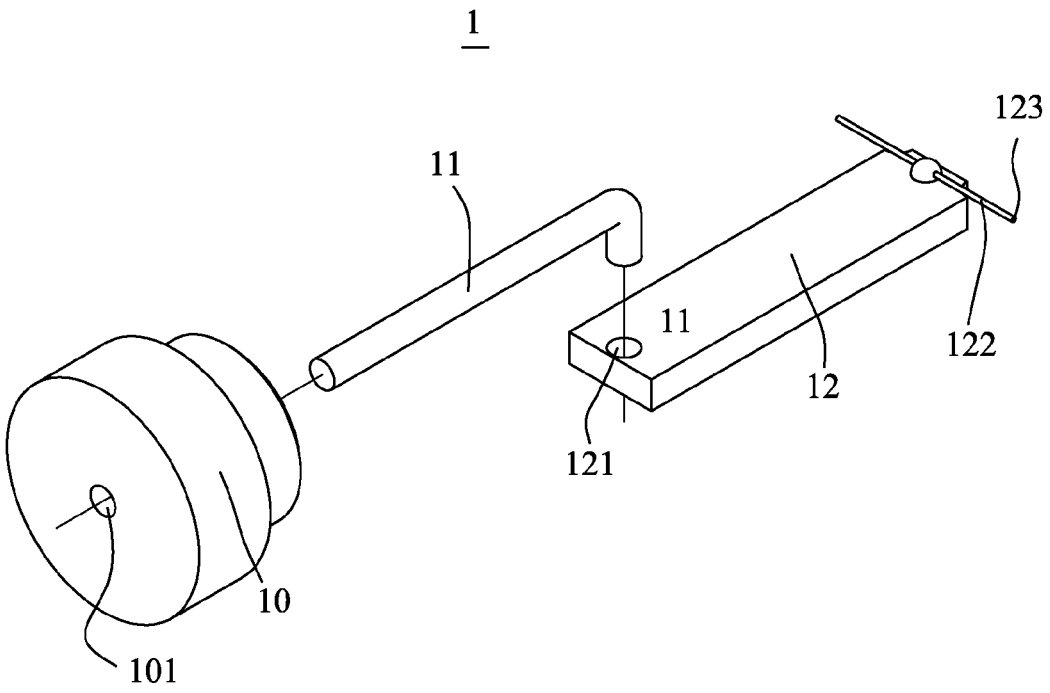
FIG. 1 (Prior Art)
FIG. 1 is an exploded perspective view of a conventional terminal load.
Figure 2:
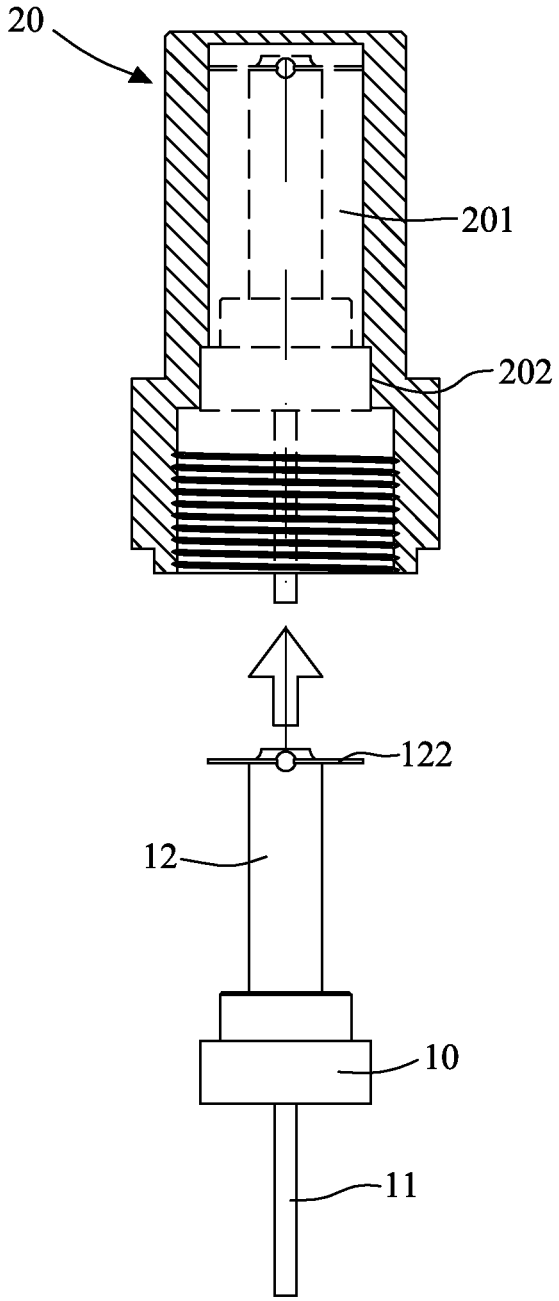
FIG. 2 (Prior Art)
FIG. 2 shows the assembling of the conventional terminal load of FIG. 1 to an outer housing.
Figure 3:
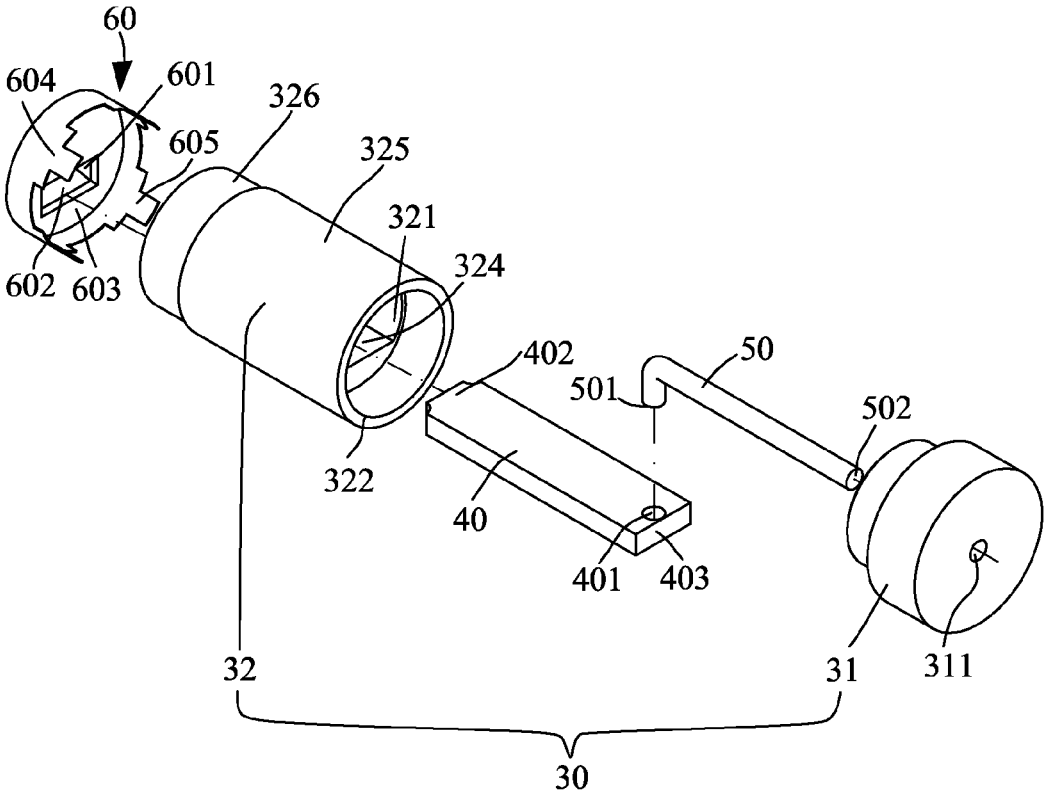
FIG. 3 is an exploded perspective view of a terminal load according to a preferred embodiment of the present invention.
Figure 4:
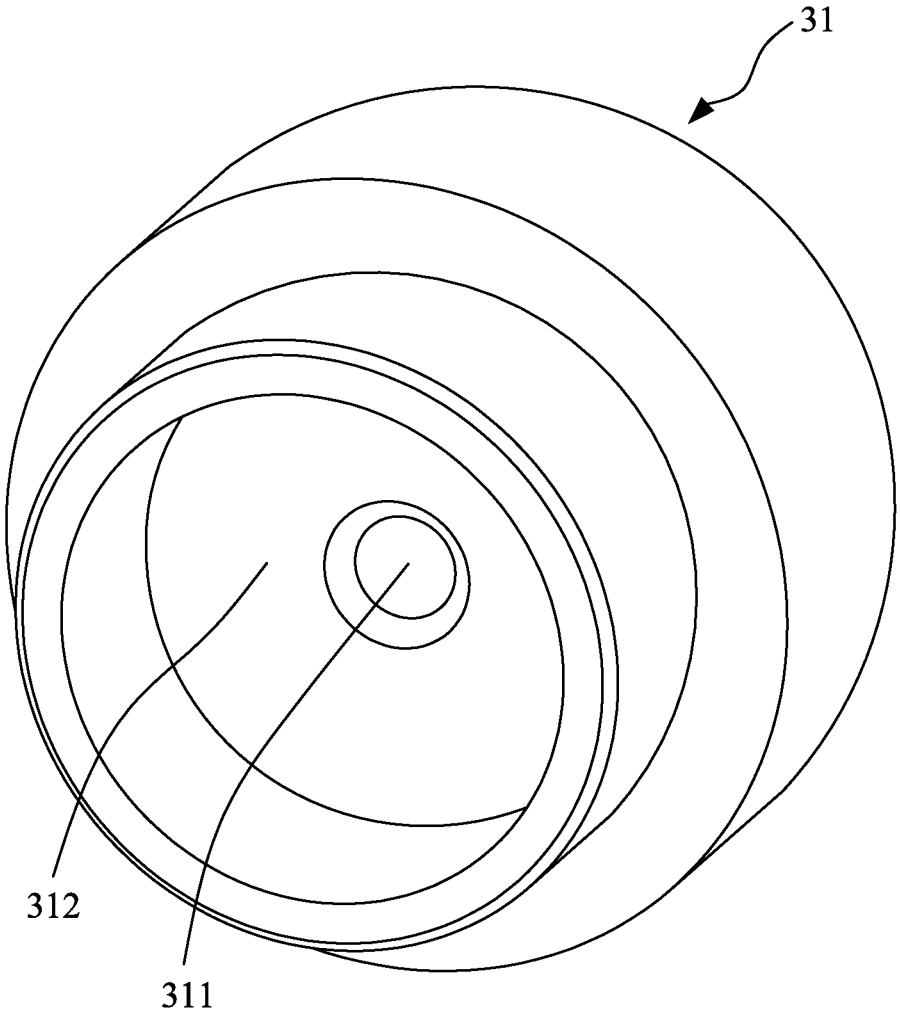
FIG. 4 is a perspective view of an insulating cap for the terminal load of FIG. 3.
Figure 5:
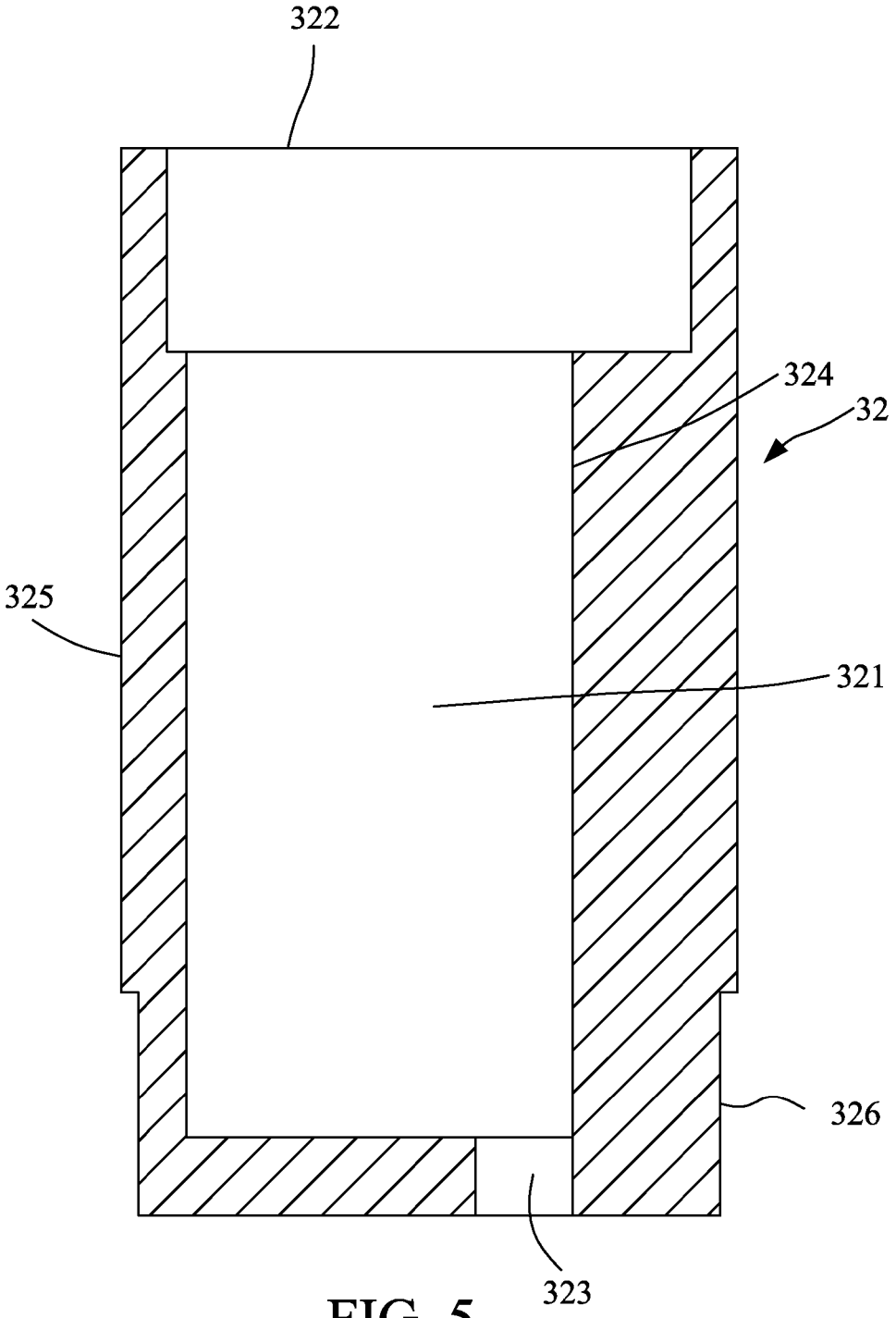
FIG. 5 is a sectional view of an insulating cylinder for the terminal load of FIG. 3.
Figure 6:
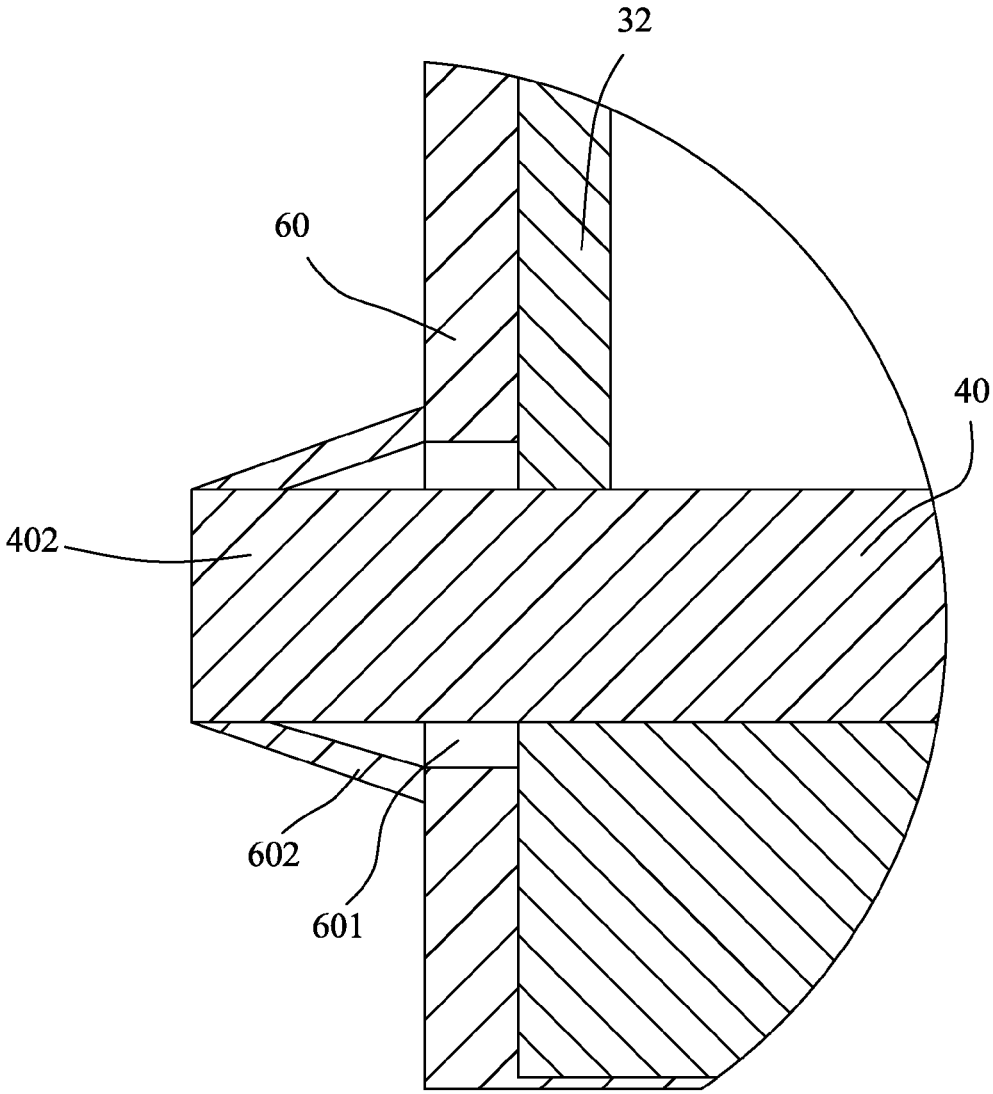
FIG. 6 is a partially enlarged sectional view showing a portion of the terminal load of the present invention, at where a circuit board is engaged with two contacting arms on a conductive cap of the terminal load.

Please refer to FIG. 3. A terminal load according to a preferred embodiment of the present invention includes an insulating housing 30, a circuit board 40, a connection terminal 50 and a conductive cap 60, which are assembled together to form the terminal load.

As shown, the insulating housing 30 includes an insulating cap 31 and an insulating cylinder 32. The insulating cap 31 has a centered third hole 311. The insulating cylinder 32 internally defines a receiving space 321, a front end of which is an opening 322 and a rear end of which is formed with a notch 323. An outer circumferential surface of the insulating cylinder 32 is divided into two sections, one of which adjacent to the opening 322 has a first outer diameter 325 and another of which adjacent to the notch 323 has a second outer diameter 326, giving the insulating cylinder 32 a stepped exterior forming two concentric cylinders. In the illustrated preferred embodiment, the first outer diameter 325 is slightly larger than the second outer diameter 326. In the receiving space 321 in the insulating cylinder 32, there is a locating surface 324. And, the insulating cap 31 is mounted to the opening 322.

Please refer to FIGS. 3 to 6 at the same time. The circuit board 40 is mounted on the locating surface 324, and is provided on a front end with a fourth hole 401. The circuit board 40 is rearwardly extended through the opening 322 toward the notch 323, such that a length of narrowed section 402 formed at a rear end of the circuit board 40 is projected from and clamped in the notch 323.

The connection terminal 50 has a first end 501 fitted in the fourth hole 401 to thereby electrically connect with the circuit board 40, and a second end 502 forwardly extended through the third hole 311 until a first contact surface 312 in the insulating cap 31 is pressed against a second contact surface 403 at the front end of the circuit board 40.

As can be seen in FIG. 3, the conductive cap 60 is provided on a top wall 603 with a fifth hole 601, which is configured and located corresponding to the rear narrowed section 402 of the circuit board 40 and has two contacting arms 602 rearwardly extended from two opposite sides thereof, so that the narrowed section 402 projected from the notch 323 also extends through the fifth hole 601 to be clamped between and in surface contact with the two contacting arms 602. A plurality of clamping surfaces 604 is forward extended from and spaced along an outer edge of the top wall 603 of the conductive cap 60. The clamping surfaces 604 respectively have two stepped lateral sides and an extended central section 605, and are fitted around the end of the insulating cylinder 32 having the notch 323 formed thereon. More specifically, the extended central sections 605 of the clamping surfaces 604 respectively have a length longer than that of the section of the insulating cylinder 32 having the second outer diameter 326 to thereby clamp on part of the section of the insulating cylinder 32 having the first outer diameter 325.

Figure 7:
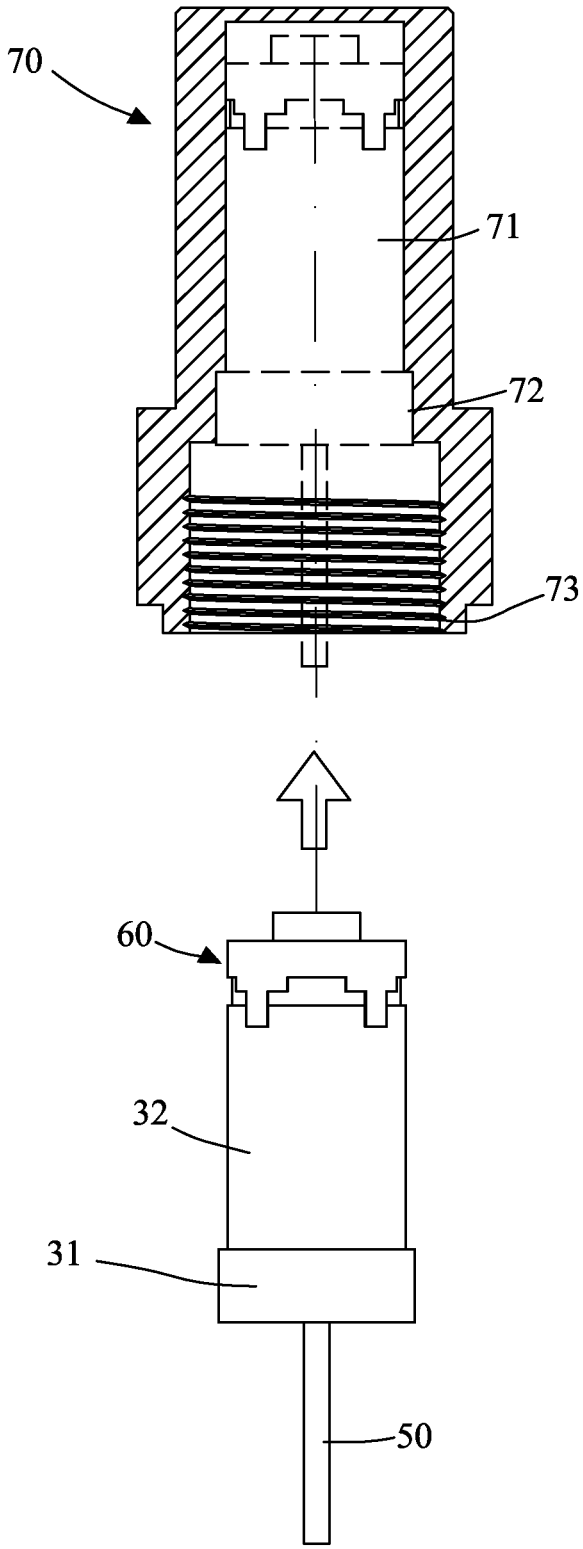
FIG. 7 shows the assembling of the terminal load of the present invention to an outer housing.

FIG. 7 shows the terminal load of the present invention is further assembled to an outer housing 70. The outer housing 70 includes a barrel portion 71 fitted on an outer side of the insulating housing 30. A front open end of the barrel portion 71 is expanded in both inner and outer diameters to form an integral locking ring portion 72, an inner surface of which is provided with screw threads 73.

When the terminal load according to the present invention is assembled to the outer housing 70 by making a punch on the insulating cap 31, both of the insulating cap 31 and the conductive cap 60 have their outer circumferential surfaces in tight contact with an inner circumferential surface of the barrel portion 71. Therefore, the occurrence of a shaking terminal load in the outer housing 70 is avoided. In addition, with an increased contact surface area between the outer circumferential surface of the conductive cap 60 and the inner circumferential surface of the barrel portion 71, as well as the surface contact between the contacting arms 602 and the rear narrowed section 402 of the circuit board 40, effectively upgraded conducting effect of the terminal load can be ensured.

In conclusion, the terminal load according to the present invention is characterized by the insulating housing that provides protection to the connection terminal and the circuit board mounted therein, so that the terminal load can be safely punched into the outer housing to enable quick production process and upgraded production efficiency as well as reduced manufacturing cost and increased profits; the conductive cap that provides increased contact surface and accordingly tight contact with the barrel portion of the outer housing to ensure improved conducting effect; and the circuit board that is mounted on the locating surface in the insulating cylinder and has rear narrowed section fitted in the notch formed on the rear end of the insulating cylinder without the risk of shaking during use, making the terminal load more reliable for use.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A terminal load, comprising:

an insulating housing including:

an insulating cylinder internally defining a receiving space, and having a front end forming an opening and a rear end provided with a notch; and an insulating cap having a centered third hole and mounted to the opening of the insulating cylinder;

a circuit board being mounted in the receiving space in the insulating cylinder and having a rear end formed into a length of narrowed section to extend through and project from the notch on the rear end of the insulating cylinder;

a connection terminal being electrically connected to a front end of the circuit board to forward extend through the third hole and project from the insulating cap; and a conductive cap being fitted around the rear end of the insulating cylinder provided with the notch and having a fifth hole formed on a top wall thereof; and the rear narrowed section of the circuit board being extended through the fifth hole to project from the conductive cap.

2. The terminal load as claimed in claim 1, wherein the receiving space in the insulating cylinder internally provides a locating surface, to which the circuit board is mounted to locate in place.

3. The terminal load as claimed in claim 1, wherein the circuit board is provided at the front end with a fourth hole, through which the connection terminal is extended to electrically connect with the circuit board.

4. The terminal load as claimed in claim 1, wherein the conductive cap includes a plurality of clamping surfaces forward extended from and spaced along an outer edge of the top wall to clamp on the insulating housing.

5. The terminal load as claimed in claim 4, wherein the clamping surfaces respectively have two stepped lateral sides and an extended central section; and the extended central sections being fitted around a length of the rear end of the insulating cylinder having the notch formed thereon.

6. The terminal load as claimed in claim 1, wherein the conductive cap further includes two contacting arms rearwardly extended from two opposite sides of the fifth hole to clamp on and get in surface contact with the rear narrowed section of the circuit board.

7. The terminal load as claimed in claim 1, further comprising an outer housing fitted on an outer side of the insulating housing; the outer housing including a barrel portion, a front open end of the barrel portion being expanded in both inner and outer diameters to form an integral locking ring portion, and the locking ring portion being provided on an inner surface with screw threads.

* * * * *